US006097359A

United States Patent [19]

Kwon et al.

[11] Patent Number: 6,097,359

[45] Date of Patent: Aug. 1, 2000

[54] CELL DRIVING DEVICE FOR USE IN A FIELD EMISSION DISPLAY

[75] Inventors: Oh Kyong Kwon; Young Sun Na; Chang Ho Hyun, all of Seoul; Gun Mu Her, Busan, all of Rep. of Korea

[73] Assignee: Orion Electric Co., Ltd., Kyungsangbuk-do, Rep. of Korea

[21] Appl. No.: 08/875,537

[22] PCT Filed: Nov. 30, 1996

[86] PCT No.: PCT/KR96/00227

§ 371 Date: Oct. 21, 1997

§ 102(e) Date: Oct. 21, 1997

[87] PCT Pub. No.: WO97/22134

PCT Pub. Date: Jun. 19, 1997

[30] Foreign Application Priority Data

Nov. 30, 1995 [KR] Rep. of Korea ..... 95-45457

[51] Int. Cl.[7] ..... G09G 3/22

[52] U.S. Cl. ..... 345/74; 345/75; 345/211

[58] Field of Search ..... 345/74, 75, 132, 345/55, 204, 76; 315/169.1, 169.3, 204, 167, 205

[56] References Cited

U.S. PATENT DOCUMENTS 5,103,145 4/1992 Doran .
5,157,309 10/1992 Parker et al. ..... 315/169
5,210,472 5/1993 Casper et al. .
5,300,862 4/1994 Parker et al. .
5,457,356 10/1995 Parodos .
5,644,195 7/1997 Browning ..... 315/169.3
5,786,795 7/1998 Kishino et al. ..... 345/75
5,847,515 12/1998 Lee et al. ..... 315/169.1

FOREIGN PATENT DOCUMENTS 2707032 12/1994 France .
WO 97/22134 6/1997 WIPO .

*Primary Examiner*—Steven J. Saras
*Assistant Examiner*—Fritz Alphonse
*Attorney, Agent, or Firm*—Merchant & Gould P.C.

[57] ABSTRACT

A cell driving device of a field emission display according to a passive matrix addressing method having a field emission pixel cell with a cathode (10) and a gate electrode (12) for emitting electrons from the cathode. The cell driving device includes at least two current sources (18, 20) disposed to provide a current signal to the cathode; and a controlling part (22) for selectively driving at least two current sources (18, 20) according to the size of a video signal.

4 Claims, 6 Drawing Sheets

CELL DRIVING DEVICE FOR USE IN A FIELD EMISSION DISPLAY

TECHNICAL FIELD

The present invention relates to a field emission element under use of cold-cathode and electric field, and more particularly to a cell driving device of a field emission display (hereinafter, called it "FED") which is capable of providing a gray level over a predetermined scale to a pixel by regulating the amount of current supplied to a cathode.

BACKGROUND ART

A cathode-ray tube (CRT) is a vacuum tube of a particular structure, which is useful to a various of electronic apparatus called a general display such as a television receiver, an oscilloscope, and a computer monitor. The original function of the CRT is to convert information included in an electric input signal into optical beam energy, and then to visibly display the electric input signal.

In the CRT, the electrons emitted from the thermionic cathode are focused and accelerated through focusing and accelerating electrodes. Also, the electronic beam deflects from a deflection coil on axes of the vertical or horizontal direction and then impacts upon a fluorescent film coated on a face plate of the cathode-ray tube to thereby display a predetermined picture.

The input signal having information to be displayed is provided to a plurality of grids and cathodes. However, since beam current called gamma characteristic is a non-linear function of control voltage, the more complicated compensating circuit should be disposed between the input signal and the plurality of grids to provide linear display intensity.

During the last several years, the trend is moving from a plate display toward development of a non-thermionic cathode, i.e., a field emission array.

The use of the field emission cathode array, instead of the conventional thermionic cathode in the CRT provides some merits. In particular, the use of the field emission cathode enables current density to be very high and lengthens the life of the CRT by eliminating a heat element.

However, according to the field emission cathode, the emission amount of electron for the input signal can be more non-linearly changed than in the thermionic cathode, so that there should be a more complicated compensating circuit in the field emission cathode.

In order to solve such a problem, here are two cell driving devices of the FED, one of which is based on a passive matrix addressing method disclosed in U.S. Pat. No. 5,103,145 and proposed by Doran. The other is based on an active matrix addressing method disclosed in U.S. Pat. No. 5,306,862 and proposed by Parker.

According to the U.S. Pat. No. 5,103,145, the cell driving device of the FED in accordance with the passive matrix addressing method converts an input signal into a digital signal and increases linearly the emission amount of the electron by increasing the number of cathodes driven depend upon a logic value of the digital signal. In this case, more gray levels are implemented by the number of cathodes. Thus, it is difficult to embody the gray levels over a predetermined limitation because there could be a limited number of cathodes to be installed in an occupying area of the cell.

In addition, the cell driving device of the FED in accordance with the passive matrix addressing method employs a voltage driving method which permits the electron to be emitted by voltage differential between the cathode and a gate. However, in this case, the current for voltage is non-linearly changed. Therefore, a problem may arise in that it is difficult to accurately regulate the amount of electrons emitted, from the cathode, In contrast, the cell driving device of the FED according to the active matrix addressing method disclosed in the U.S. Pat. No. 5,300,862 is intended to drive pixels of high electric field under use of both an integrated circuit consisting of CMOS or NMOS transistors and an input signal at a low voltage. In addition, the cell driving device of the FED according to the active matrix addressing method uses a MOS transistor at a high voltage as a scan and a data switch in order to drive the cathode arranged in 9 row lines and 8 column lines. Further, the cell driving device of the FED according to the active matrix addressing method comprises fuses connected between a column driver and the cathode, a field effect transistor coupled between the cathode and the gate. The fuses limit the current so that overcurrent is not applied to the cathode. The field effect transistor used as a resistance regulates the amount of the electron emitted from the cathode by regulating the voltage differential between the cathode and the gate terminal through the adjustment of its own resistance value. Thereby, the light degree of the screen is adjusted. The column driver implements the more gray levels by regulating the time required in driving the cathodes of the column lines, i.e., duty cycle.

However, the cell driving device of the FED according to the active matrix addressing method should use the MOS transistor for high voltage in order to switch a high-voltage supplied to scan and data lines. Further, the cell driving device of the FED according to the active matrix addressing method should be subjected to form a thick gate terminal of the field effect transistor coupled between the gate terminal and the cathode. Thereby, the cell driving device of the FED according to the active matrix addressing method needs the more transistors than that of the FED according to the passive matrix addressing method, and its manufacturing process is complicated.

Moreover, there is a limited the number of adjustable duty cycles for implementing more gray levels, so that it is impossible to embody the gray levels over a predetermined limitation.

DISCLOSURE OF INVENTION

Accordingly, the present invention is directed to a cell driving device of a field emission display capable of implementing a gray level over a predetermined limitation by simplifying circuits under a process according to the active matrix addressing method, and by regulating the amount of current supplied to the cathode under employment of the passive matrix addressing method.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve the above object in accordance with the present invention, as embodied and broadly described, the cell driving device of the, field emission display comprises at least two current sources disposed to provide a current signal to the cathode; and a controlling part for selectively driving at least two current sources according to the size of a video signal.

It is to be understood that both the foregoing general description and the following detailed description are exemplary and explanatory and are intended to provide further explanation of the invention as claimed.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

BEST MODE FOR CARRYING OUT THE INVENTION

Reference will now be made in detail to the preferred embodiments of the present invention, examples of which are illustrated in the accompanying drawings.

It will be apparent to those skilled in the art that various modifications and variations can be, made in a cell driving device of the field emission display of the present invention without departing from the spirit or scope of the invention. Thus, it is intended that the present invention cover the modifications and variations of this invention provided that they come within the scope of the appended claims and their equivalents.

Figure 1:
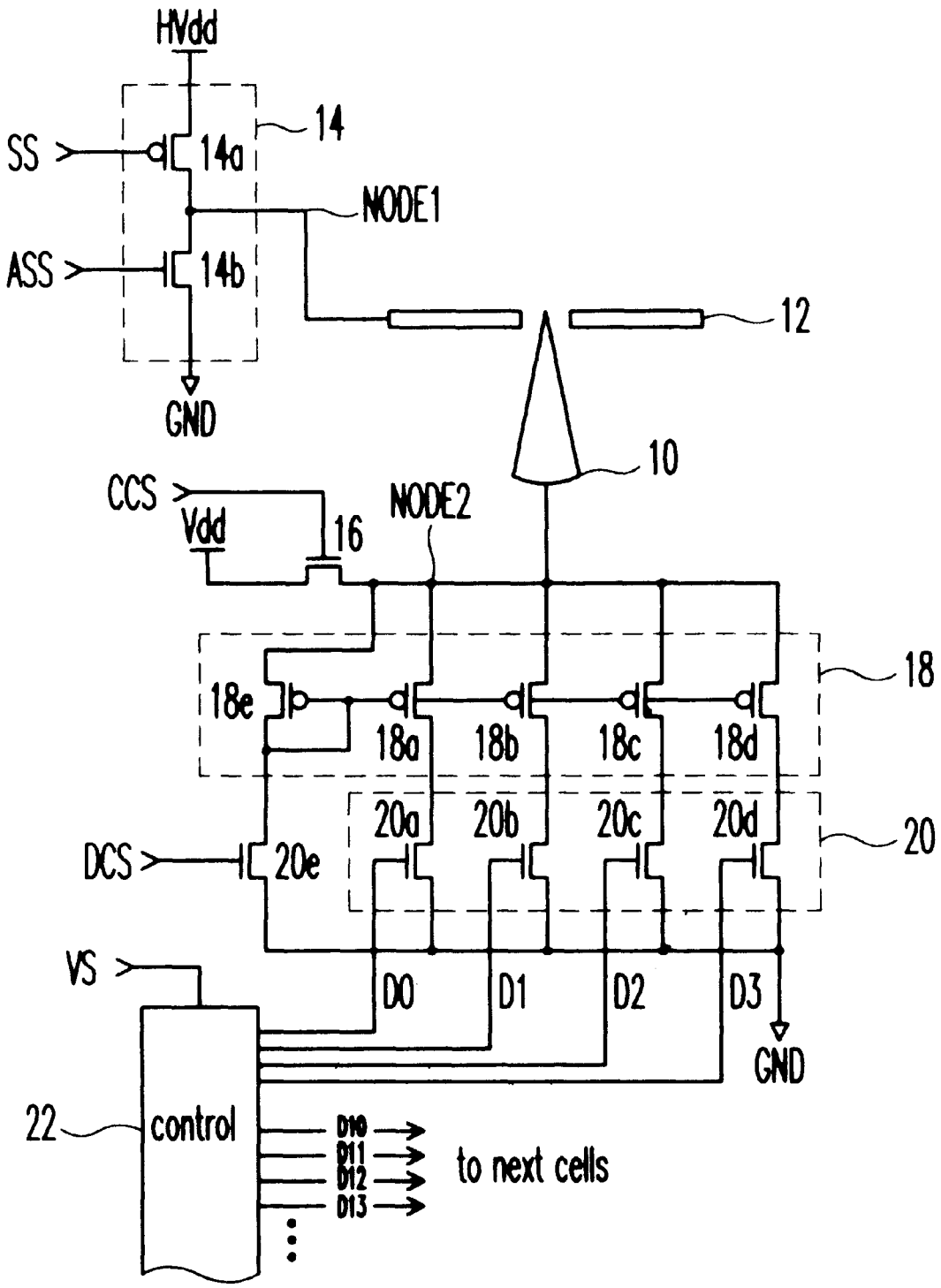
FIG. 1 is a first circuit diagram of a cell driving device of a field emission display according to one embodiment of the present invention.

Referring to FIG. 1, there are provided in a cell driving device of a field emission display a cathode 10, a gate electrode 12 for emitting electron from the cathode, a high-voltage switching part 14 for switching a high-voltage source HVdd and a ground voltage GND from the gate electrode 12, and a seventh NMOS transistor 16 for switching a low-voltage Vdd to be provided to the cathode 10.

Figure 3:
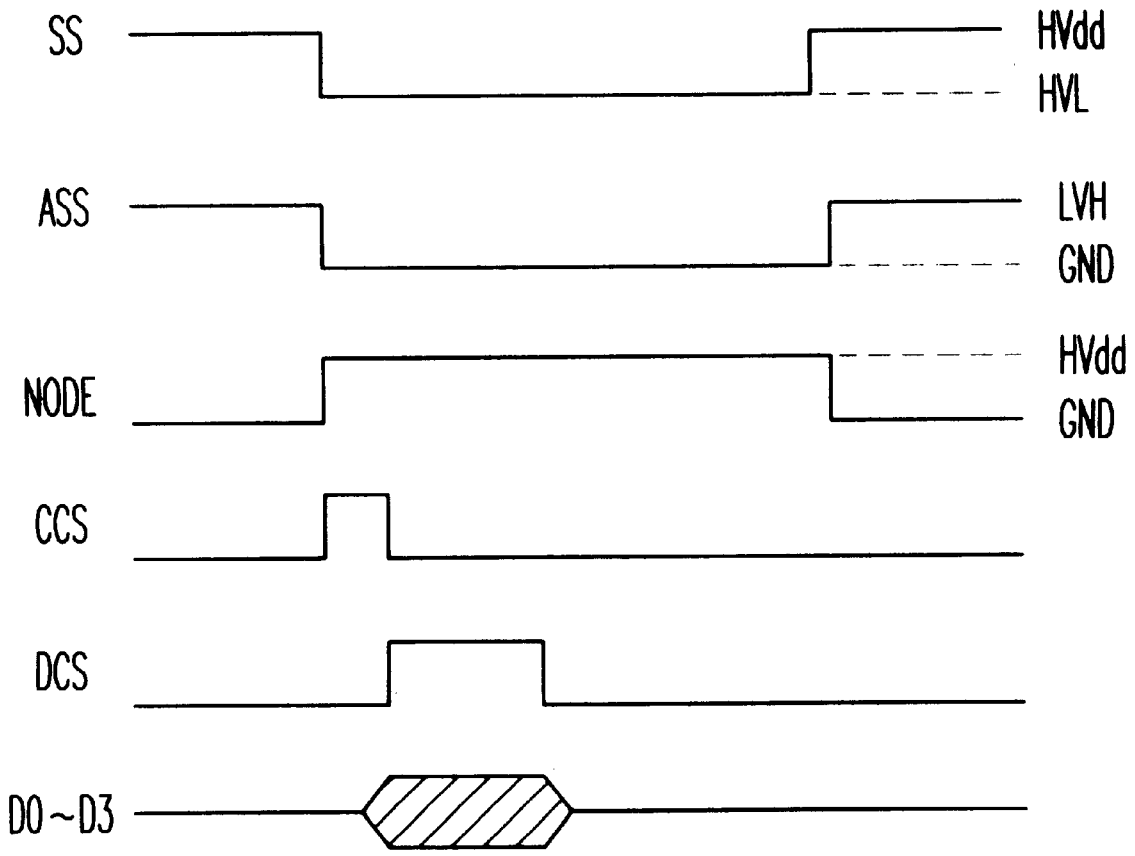
FIG. 3 is a timing diagram of a control signal supplied to the driving device shown in FIG. 1.

The high-voltage switching part 14 provides the high-voltage HVdd to the gate electrode 12 via a first node NODE 1 by means of main and auxiliary scan signals SS and ASS, as shown in FIG. 3, during the logic low level of the main scan signal SS. Thus, the high-voltage switching part 14 should have a sixth PMOS transistor 14*a* connected between the high-voltage HVdd and the first node NODE 1 and a sixth NMOS transistor 14*b* coupled between the first node NODE 1 and the ground voltage GND.

The sixth PMOS transistor 14*a* is turned on during the logic low level of the main scan signal SS to be applied to its own gate, and then provides the high-voltage HVdd to the gate electrode 12 via the first node NODE 1. At this moment, the voltage applied to the gate terminal of the sixth NMOS transistor 14*b* should be at the logic "low" and the sixth NMOS transistor 14*b* should thus be turned off.

In the meantime, the sixth PMOS transistor 14*a* should be turned off and the sixth NMOS transistor 14*b* should be turned on to provide the ground voltage GND to the gate electrode 12. Also, the voltage applied to the gate terminal of the sixth PMOS transistor 14*a* and the other voltage applied, to, the gate terminal of the, sixth NMOS transistor 14*b* should all be at the logic "high" level so that the sixth PMOS and NMOS transistors 14*a* and 14*b* can be turned off and turned on, respectively. Thereby, while the high-voltage is applied to the gate electrode 12 from the first node NODE 1, the electron is emitted from the cathode 10.

The high level of the main scan signal SS is maintained at the high-voltage HVdd and the low level thereof is maintained at the lower voltage HVL than the high-voltage HVdd by 0.7 to 0.5 volts. In addition, the low level of the auxiliary scan signal ASS should be maintained at the ground voltage GND, but on the other hand, the high level thereof should be maintained at the higher voltage than the ground voltage by 0.7 to 0.5 volts. This prevents the damage of oxidation films of the gates of the sixth PMOS and NMOS transistors 14*a* and 14*b* by limiting the voltage differential between a source terminal and the gate terminal of the sixth PMOS and NMOS transistors 14*a* and 14*b*. Further, this is to stably switch the high-voltage HVdd and the ground voltage GND applied to the gate electrode 12 through the first node NODE 1.

Meanwhile, the seventh NMOS transistor 16 is selectively driven according to the logic state of a charge control signal CCS. While the charge control signal CSS is maintained at the logic high level, the seventh NMOS transistor 16 is turned on and the low-voltage is thus applied to the cathode 10. When the high-voltage HVdd is provided to the gate electrode 12, as shown in FIG. 3, the charge control signal CSS is maintained at the logic high level for a while, and is again maintained at the logic low level. Also, the pulse width at the logic high level is very short, unlike that of the high-voltage HVdd applied to the gate electrode 12. Meanwhile, the low-voltage is applied to the cathode 10 for a while so that current sources 18 and 20 between a second node NODE 2 and the ground voltage GND can be operated by voltage floating of the second node NODE 2 of FIG. 1. This is associated with the manufacture of a chip of the FED. That is, it is intended that no voltage is provided to the second node NODE 2, even though the high-voltage is applied to the gate 12. However, if a predetermined voltage is applied to the second node NODE 2 by a capacitance between the gate electrode 12 and the cathode 10, the cell driving, device of the FED like FIG. 2 can be proposed.

The cell driving device of the FED of FIG. 1 further comprises a current mirror 18 connected between the cathode 10 and the ground voltage GND, and a fifth NMOS transistor 20*e* for controlling an operation of the current mirror 18.

The current mirror 18 has four current sources capable of providing different current signals to the cathode 10. Therefore, the current mirror 18 further has first to fourth PMOS transistors 18*a* to 18*d* whose source terminals are connected to the cathode 10, and a fifth PMOS transistor 18*e* whose source terminal is coupled to the low-voltage Vdd through the seventh NMOS transistor 16.

The gate terminal of the fifth PMOS transistor 18*e* is commonly connected to gate terminals of the first to fourth PMOS transistors 18*a* to 18*d* and is also coupled to a drain terminal of the fifth NMOS transistor 20*e*. When a current path is formed by the fifth NMOS transistor 20*e*, the fifth PMOS transistor 18*e* permits a voltage similar to the ground voltage GND to be applied to the gate terminals of the first to fourth PMOS transistors 18*a* to 18*d*, so that the first to fourth PMOS transistors 18*a* to 18*d* are driven at the same voltage.

In response to a display control signal DCS, the fifth NMOS transistor 20*e* forms the current path of the fifth PMOS transistor 18*e*. In the case where the display control signal is maintained at the logic high level, the fifth NMOS transistor 20*e* is turned on and current flows into the ground voltage GND from the drain terminal of the fifth PMOS transistor, 18*e*. The display control signal DCS is synchronized with digital logic signals D0 to D3, or D10 to D13 provided to the cells of the FED in a controlling part 22, and is thus applied to the gate terminal of each transistor like the fifth NMOS transistor 20*e*. FIG. 3 is a timing diagram of the display control signal DCS and the digital logic signal D0 to D3 shown in FIG. 1.

Further, while the ground voltage GND is applied to the gate terminals of the first to fourth PMOS transistors 18*a* to 18*d* from the drain terminal of the fifth PMOS transistor 18*e*, the first to fourth PMOS transistors 18*a* to 18*d* form an electric path in their own drain terminals from the cathode 10. At this point, the first to fourth NMOS transistors 20*a* to 20*d* each connected in series to the drain terminals of the first to fourth PMOS transistors 18*a* to 18*d* control the current paths between the drain terminals of the first to fourth PMOS transistors and the ground voltage GND, respectively. Also, the first to fourth NMOS transistors 20*a* to 20*d* also respond to the digital logic signals D0 to D3 of 4 bits from the controlling part 22. That is, the first to fourth PMOS transistors 18*a* to 18*d* generate the current signals of constant size and then provide the signals to the cathode 10. However, at the moment, even, though all of the current signals generated from the first to fourth PMOS transistors 18*a* to 18*d* could have the same size, it is desired that the amount of the current is increased by $2^N$ (n=1, 2, 3, . . . from one current signal generated by the PMOS transistor 18*a* of least significant bit to the other current signal generated by the PMOS transistor 18*d* of most significant bit. Therefore, it is also desired that the widths of channels of the second to fourth PMOS transistors 18*b* to 18*d* should be each twice, four times, and eight times as large as that of channel of the first PMOS transistor 18*a*. For example, if the amount of the current in the drain terminal of the first PMOS transistor 18*a* is 100 $\mu$A, the current of 200 $\mu$A, 400 $\mu$A, and 800 $\mu$A flow into the drain terminals of the second to fourth PMOS transistors 18*b* to 18*d*, respectively.

In the meantime, the cell driving device of the FED further comprises a current valve 20 coupled between the current mirror 10 and the ground voltage GND, and a controlling part 22 for controlling the current valve 20.

Video signals vs inputted to the controlling part 22 are converted into the digital logic signals Do to D3 of 4 bits in, the controlling part 22, and are then applied to the gate terminals of the first to fourth NMOS transistors 20*a* to 20*d*, respectively. The controlling part 22 can be by an analog-digital converter or an encoder.

The current valve 20 opens or closes each of the current paths of the four current sources included in the current mirror 18. Accordingly, the current valve 20 should have the first to fourth NMOS transistors 20*a* to 20*d* each connected to the drain terminals of the first to fourth PMOS transistors 18*a* to 18*d* and the ground voltage GND.

The first to fourth NMOS transistors 20*a* to 20*d* are selectively driven according to the digital logic signals D0 to D3 each applied to their own gate terminals, so that the current paths between the cathode 10 and the ground voltage GND are selectively formed.

For example, if the digital logic signals of 4 bits are given as "D=1, D1=0, D2=0, D3=0", only the first NMOS transistor 20*a* is turned on and only the current path via the first PMOS transistor 18*a* and the first NMOS transistor 20*a* is formed between the cathode 10 and the ground voltage GND. Thereby, the current signal applied to the cathode 10 is 100 $\mu$A, and the amount of the current emitted from the cathode is shown like a curve 51 of FIG. 5.

In addition, if the digital logic signals of 4 bits are given as "D0=0, D1=1, D2=0, D3=0", only the second NMOS transistor 20*b* is, turned on and only the current path via the second PMOS transistor 18*b* and the second NMOS transistor 20*b* is formed between the cathode 10 and the ground voltage GND. Thereby, the current signal applied to the cathode 10 is 200 $\mu$A, and the amount of the current emitted from the cathode is shown like a curve 52 of FIG. 5.

Further, if the digital logic signals of 4 bits are given as "D0=0, D1=0, D2=1, D3=0", only the third NMOS transistor 20*c* in turned on and only the current path via the third PMOS transistor 18*c* and the third NMOS transistor 20*c* is formed between the cathode 10 and the ground voltage GND. Thereby, the current signal applied to the cathode 10 is 400 $\mu$A, and the amount of the current emitted from the cathode is shown like a curve 54 of FIG. 5.

Furthermore, if the digital logic signals of 4 bits are given as "D0=0, D1=0, D2=0, D3=1", only the fourth NMOS transistor 20*d* is turned on and only the current path via the fourth PMOS transistor 18*d* and the fourth NMOS transistor 20*d* is formed between the cathode 10 and the ground voltage GND. Thereby, the current signal applied to the cathode 10 is 800 $\mu$A, and the amount of the current emitted from the cathode is shown like a curve 58 of FIG. 5.

Finally, if the digital logic signals of 4 bits are given as "D0=1, D1=1, D2=1, D3=1", the first to fourth NMOS transistor 20*a* to 20*d* are all turned on and all of the current paths via the first to fourth PMOS transistor 18*a* to 18*d* and the first to fourth NMOS transistor 20*a* to 20*d* are formed between the cathode 10 and the ground voltage GND. Thereby, the current signal applied to the cathode 10 is 1.5 mA, and the amount of the current emitted from the cathode is shown like a curve 515 of FIG. 5. Accordingly, it is possible to apply the current of 100 $\mu$A to 1.5 mA to the cathode 10 according to the combination of the digital logic signals D0 to D3 of 4 bits. Also, the widths of the channels of the first to fourth NMOS transistors 20*a* to 20*d* are large to open or close the amount of the current according to the widths of the channels of the first to fourth PMOS transistors 18*a* to 18*d*, and the widths of their channels are once, twice, four times, and eight times as large as those of the first to fourth PMOS transistors, respectively.

The widths of the channels of the fifth PMOS and NMOS transistors 18*e* and 20*e* are so designed with a very small size so that they scarcely affect total current.

In the meantime, the first to sixth PMOS transistors 18*a* to 18*e*, and 14*a*, and the first to sixth NMOS transistors 20*a* to 20*e*, and 14*b* are all high-voltage transistors.

As mentioned above, even though the high-voltage HVdd is applied to the gate electrode 12, it is unclear how much voltage is applied to the cathode 10. Therefore, the cell driving device of the FED of FIG. 1 is so designed that a predetermined voltage is applied to the cathode 10.

Figure 2:
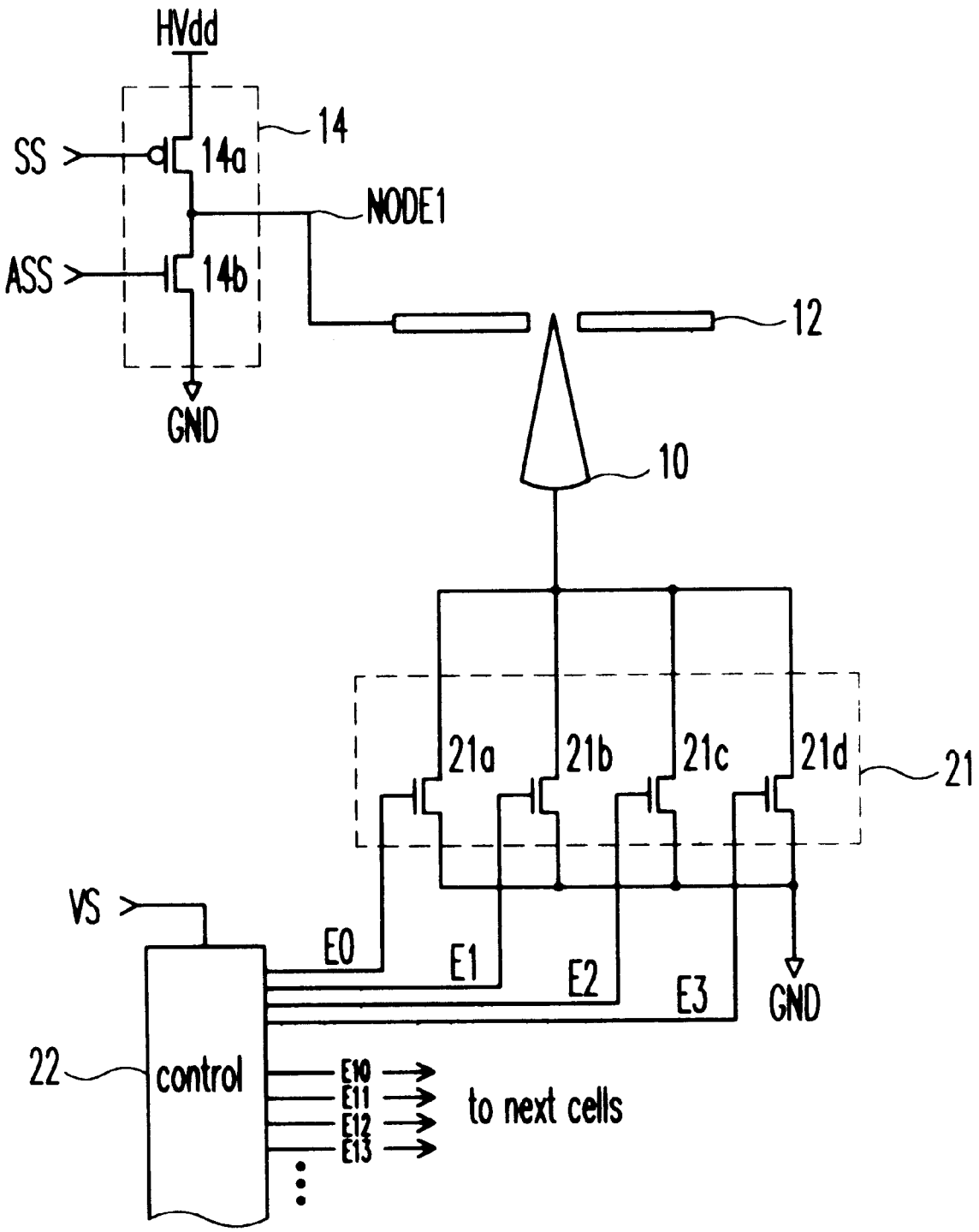
FIG. 2 is a second circuit diagram of a cell driving device of a field emission display according to the other embodiment of the present invention.

In a panel of the FED really manufactured, if the capacitance between the gate electrode 12 and the cathode 10 has an effect on providing a predetermined voltage, to the cathode 10 by means of the high-voltage applied to the gate electrode 12, the cell driving device of the FED like FIG. 2 can be proposed.

FIG. 2 is a second circuit diagram of a cell driving of a field emission display according to the other embodiment of the present invention.

The difference in FIG. 2 from FIG. 1, is to substitute four NMOS transistors 21*a* to 21*d* for the current mirror 18, current valve 20, the seventh NMOS transistor 16, and the fifth NMOS transistor 20*e*.

However, the high-voltage switching part for switching the high-voltage applied to the gate electrode 12 is the same as that of FIG. 1.

The widths of channels of the ninth to eleventh NMOS transistors 21*b* to 21*d* used as current source 21 in FIG. 2 are twice, four times, eight times as large as that of the eighth NMOS transistor 21*a* and the digital video signals E0 to E3 provided from the controlling part 22 are applied to their gate terminals.

According to the combination of the logic values of the digital, video signals, as shown in FIG. 1, the amount of the current provided to the cathode 10 is controlled.

Figure 4:
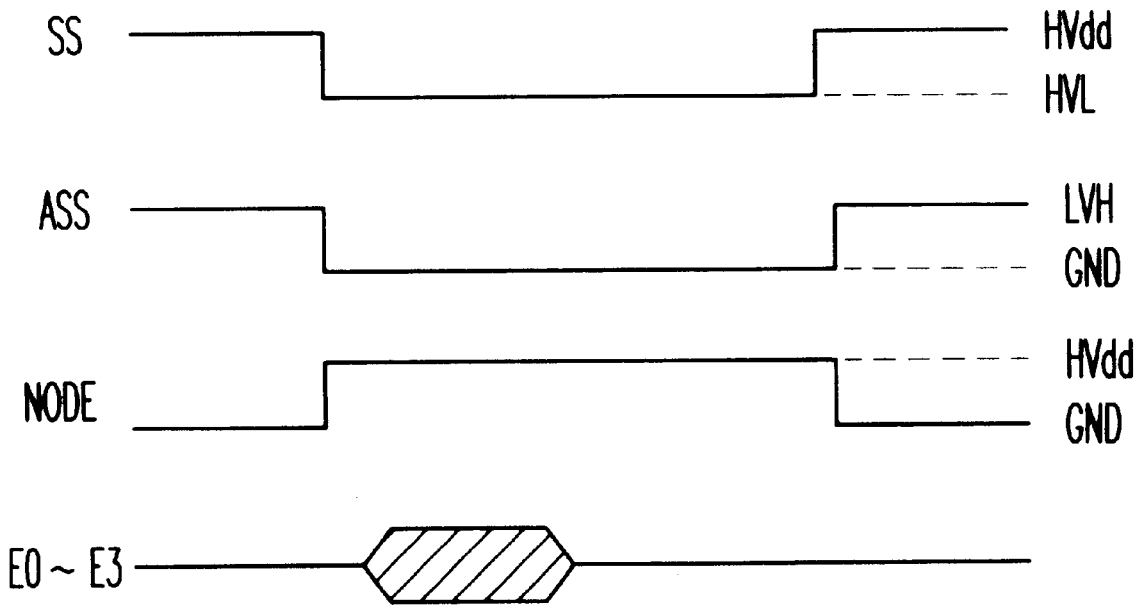
FIG. 4 is a timing diagram of a control signal supplied to the driving device shown in FIG. 2.
Figure 6:
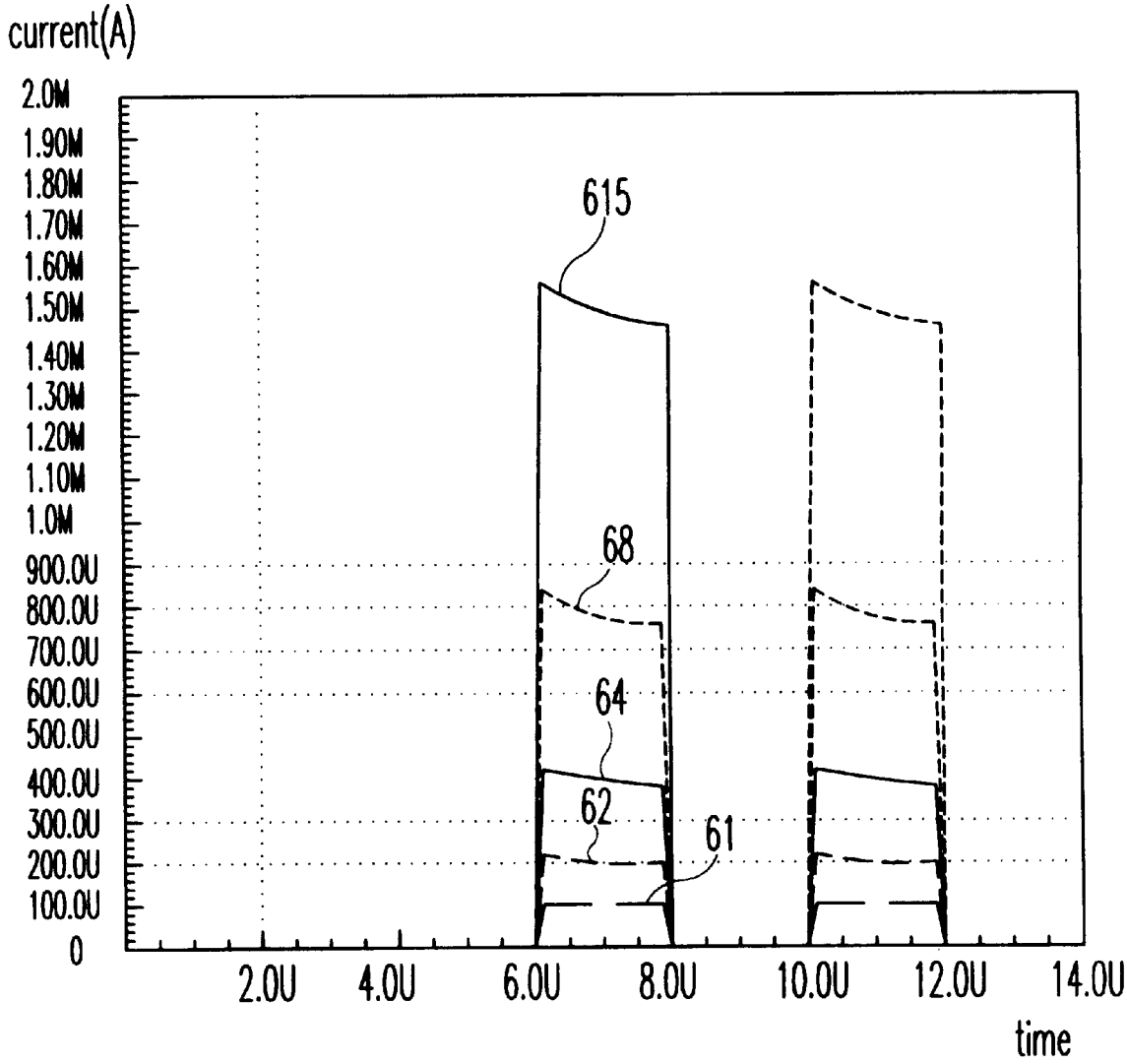
FIG. 6 shows result of a SPICE simulation for explaining characteristic of emission current amount according to the opening of current paths in the other current mirror shown in FIG. 2.

FIG. 4 is a timing diagram of each of the digital signals and FIG. 6 shows the result of a SPICE simulation of a circuit where an operation of the cell driving of the FED of FIG. 2 is performed.

Referring to FIG. 6, if values of the digital logic signals E0 to E3 of 4 bits are given as "E0=1, E1=0, E2=0, and E3=0", the only eighth NMOS transistor 21*a* is turned on and the only current path in the eighth NMOS transistor 21*a* can be formed between the, cathode 10 and the ground voltage GND.

At this time, the current signal applied to the cathode 10 is approximately 100 $\mu$A and the amount of the current emitted from the cathode 10 is shown in a curve 61 of FIG. 6.

Also, if values of the digital logic signals E0 to E3 of 4 bits are given as "E0=0, E1=1, E2=0, and E3=0", only the ninth NMOS transistor 21*b* is turned on and only the current path in the ninth NMOS transistor 21*b* can be formed between he cathode 10 and the ground voltage GND.

At this time, the current signal applied to the cathode 10 is approximately 200 $\mu$A and the amount of the current emitted from the cathode 10 is shown in a curve 62 of FIG. 6

Further, if values of the digital logic signals E0 to E3 of 4 bits are given as "E0=0, E1=0, E2=1, and E3=0", only the tenth NMOS transistor 21*c* is turned on and only the current path in the tenth NMOS transistor 21*c* can be formed between the cathode 10 and the ground voltage GND.

At this time, the current signal applied to the cathode 10 is approximately 400 $\mu$A and the amount of the current emitted from the cathode 10 is shown in a curve 64 of FIG. 6.

Furthermore, if values of the digital logic signals E0 to E3 of 4 bits are given as "E0=0, E1=0, E2=0, and E3=1", only the eleventh NMOS transistor 21*d* is turned on and only the current path in the eleventh NMOS transistor 21*d* can be formed between the cathode 10 and the ground voltage GND.

At this time, the current signal applied to the cathode 10 is approximately 800 $\mu$A and the amount of the current emitted from the cathode 10 is shown in a curve 68 of FIG. 6.

Moreover, if values of the digital logic signals E0 to E3 of 4 bits are given as "E0=1, E1=1, E2=1, and E3=1", the NMOS transistors 21*a* to 21*d* are all turned on and all current paths can be formed between the cathode 10 and the ground voltage GND.

At this time, the current signal applied to the cathode 10 is approximately 1.5 mA and the amount of the current emitted from the cathode 10 is shown in a curve 615 of FIG. 6.

Figure 5:
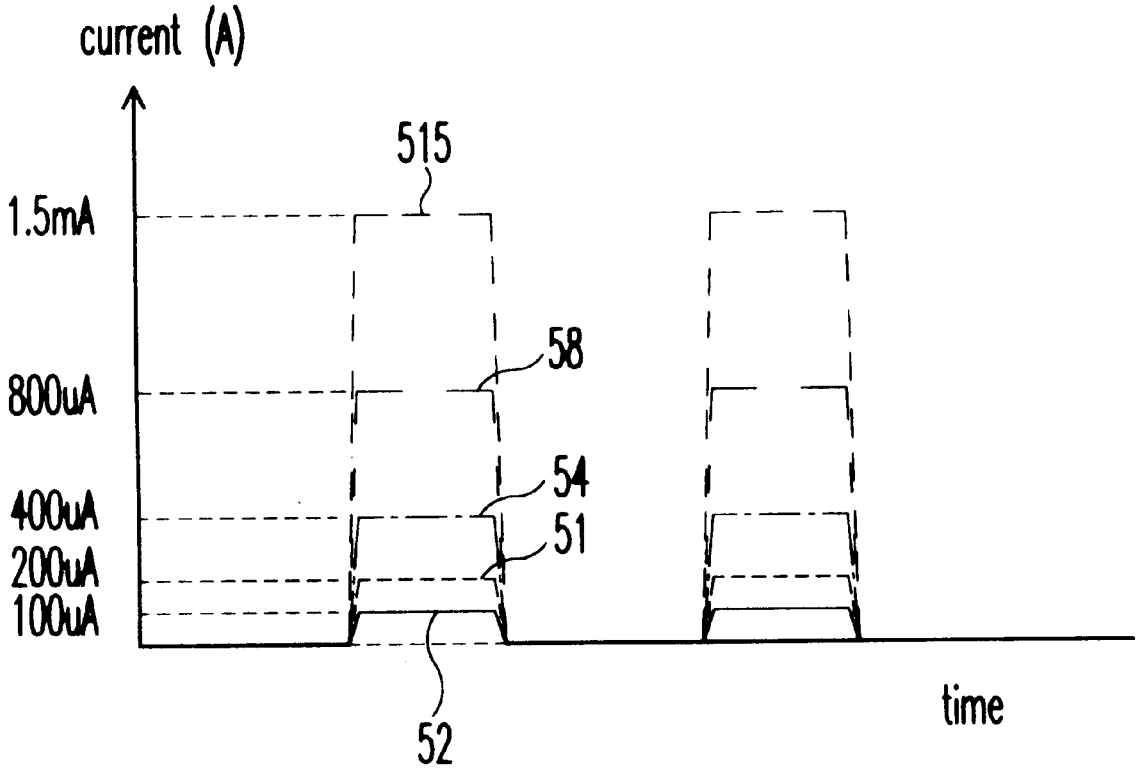
FIG. 5 shows result of a SPICE simulation for explaining characteristic of emission current amount according to the opening of current paths in one current mirror shown in FIG. 1.

In the case where characteristics of the emission current in FIG. 6 is compared with that of FIG. 5, it is understood that the emission current amount in FIG. 6 is somewhat reduced as time goes by. This results from the capacitance between the gate electrode 12 and the cathode 10.

As mentioned above, the cell driving device of the FED of the present invention selectively drives at least two current sources for providing the different amount of the current signals to the cathode according to the size of the video signal, so that the amount of the current emitted from the cathode can be linearly changed with respect to the video signal. Therefore, in accordance with the present invention, some merits are that the number of cathodes included in the pixel is increased and the area occupied by the pixel is not limited, even though the gray level is raised. Further, the cell driving device of the FED according to the present invention can provide the shade of the predetermined gray level to the pixel, regardless of the area occupied by the pixel.

Meanwhile, in the above description, even though only an cathode is implemented in FIG. 1, it is well known to those skilled in the art that several hundreds or several thousands of cathodes can be mounted in one pixel. In addition to, it can be understood that only one cathode explained in the embodiment of the present invention means several hundreds or thousands of cathodes connected in common to each other.

In the embodiment of the present invention, even though the 16 gray levels are provided to the pixel, it is well known to those skilled in the art that the shade of 32 gray levels, 64 gray levels, and 124 gray levels can be provided to the pixel.

Accordingly, it should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A cell driving device of a field emission display according to a passive matrix addressing a method having a field emission pixel cell with a cathode and a gate electrode for emitting electrons from said cathode, said cell driving device comprising:

a plurality of NMOS transistors, each NMOS transistor used as current sources disposed to provide a current signal to said cathode;

a plurality of switching parts for switching a high voltage applied to the gate electrode;

a controlling part for selectively driving said at least two current sources according to the size of a video signal; and wherein said current signals each generated in said current sources are increased by $2^N$ (N=1, 2, 3 . . . ) from one current level of a least significant bit to the other of a most significant bit.

2. The cell driving device of a field emission display as claimed in claim 1, wherein said controlling part comprises an encoder for generating at least 2 bits of logic signal where a logic value "1" is gradually increased according to the size of said video signal.

3. The cell driving device of a field emission display as claimed in claim 1, wherein said controlling part comprises an analog-digital converter for converting said video signal into at least 2 bits of digital logic signal.

4. A cell driving device of a field emission display according to a passive matrix addressing method having a field emission pixel cell with a cathode and a gate electrode for emitting electrons from said cathode, said cell driving device comprising:

at least two current sources disposed to provide a current signal to said cathode;

a controlling part for selectively driving said at least two current sources according to the size of a video signal; and wherein said current signals each generated in said at least two current sources are increased by $2^N$ (N=1,2,3 . . .) from one current level of a least significant bit to the other of a most significant bit.

* * * * *